United States Patent [19]

Sloot

[11] Patent Number: 4,715,619

[45] Date of Patent: Dec. 29, 1987

[54] BOOK JACKET

[75] Inventor: Alexander Sloot, Stamford, Conn.

[73] Assignee: Printmark, Inc., Stamford, Conn.

[21] Appl. No.: 818,553

[22] Filed: Jan. 13, 1986

[51] Int. Cl.[4] ..... B42D 3/04

[52] U.S. Cl. ..... 281/19 R; 281/32

[58] Field of Search ..... 281/31, 34, 35, 19; 402/3; D19/26, 32

[56] References Cited

U.S. PATENT DOCUMENTS

| | | | |
|---|---|---|---|
| 1,475,586 | 11/1923 | Lalonde | 281/34 |
| 1,595,002 | 8/1926 | Davis | 281/34 |
| 2,145,099 | 1/1939 | Sharp | 281/34 |
| 2,445,871 | 7/1948 | Brody | 281/34 |
| 2,475,345 | 7/1949 | Williams | 281/34 |
| 2,884,183 | 4/1959 | Frankel | 281/34 X |
| 3,165,337 | 1/1965 | Leibowitz | 281/34 |
| 3,572,767 | 3/1971 | Learned et al. | 281/34 |
| 4,209,187 | 6/1980 | Forrest | 281/19 R |
| 4,341,401 | 7/1982 | Arntzen | 281/34 |
| 4,497,508 | 2/1985 | McHugh | 281/34 |
| 4,605,245 | 8/1986 | Weaver | 281/34 |

FOREIGN PATENT DOCUMENTS

| | | | |
|---|---|---|---|
| 546227 | 4/1956 | Belgium | 281/34 |
| 807264 | 1/1937 | France | 281/34 |
| 683885 | 12/1952 | France | 281/34 |
| 1284684 | 1/1962 | France | 281/34 |
| 2048098 | 3/1971 | France . | |
| 313575 | 6/1956 | Switzerland | 281/34 |
| 404445 | 1/1934 | United Kingdom | 281/34 |
| 1575014 | 9/1980 | United Kingdom | 281/34 |

*Primary Examiner*—Paul A. Bell

*Attorney, Agent, or Firm*—St.Onge Steward Johnston & Reens

[57] ABSTRACT

A book jacket is described that can fit around a book independent of its thickness while enabling the placement of a display at a desired location with respect to the book such as its spine or front cover. In one book jacket a pocket and a sleeve are used for attachment to the front and back covers of a book and separated by a floating spine region. In another book jacket a pair of sleeves are used separated by a floating spine region. In another embodiment a flat sleeve book shield is provided that is convenient to apply to books of different thicknesses. The spine regions are uninterrupted and flexible so as to conform to the shape of many spine thicknesses. The book jacket is particularly suitable to fit around conventional directory books such as telephone books, catalogs, and airline schedules.

4 Claims, 19 Drawing Figures

FIG. 2
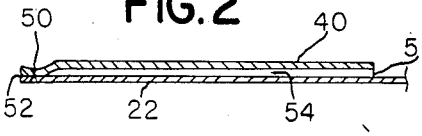
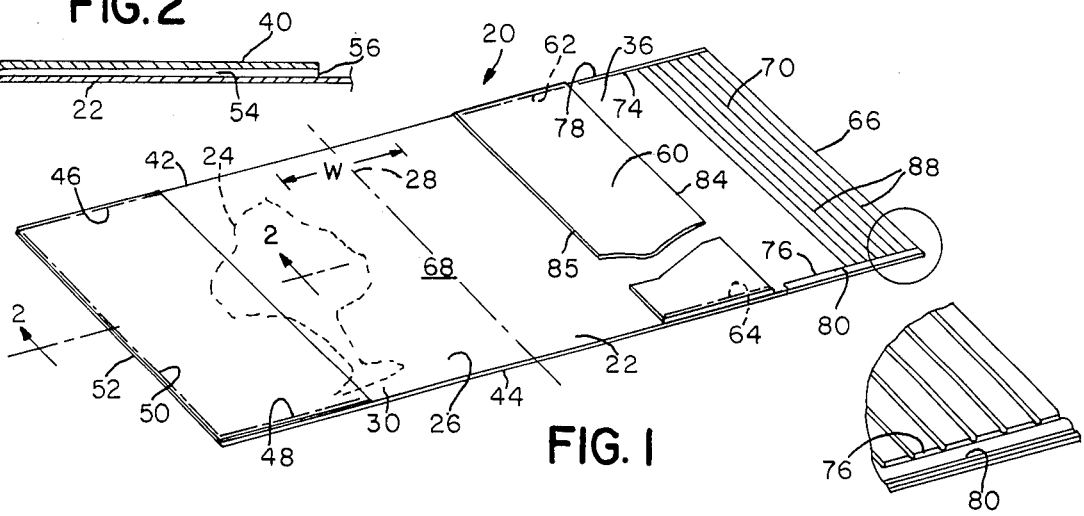
FIG. 1
FIG. 1A
FIG. 3
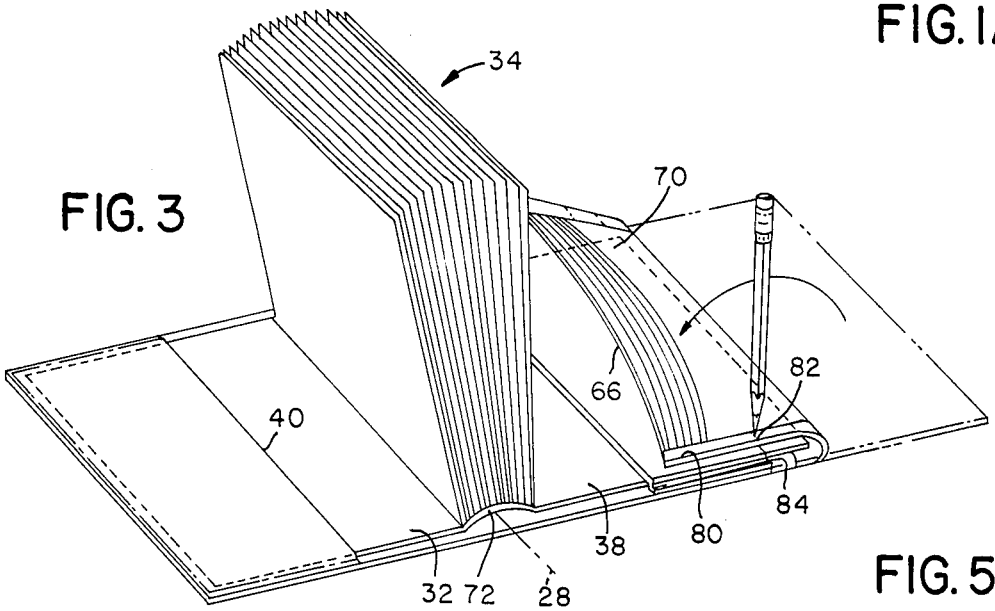
FIG. 4
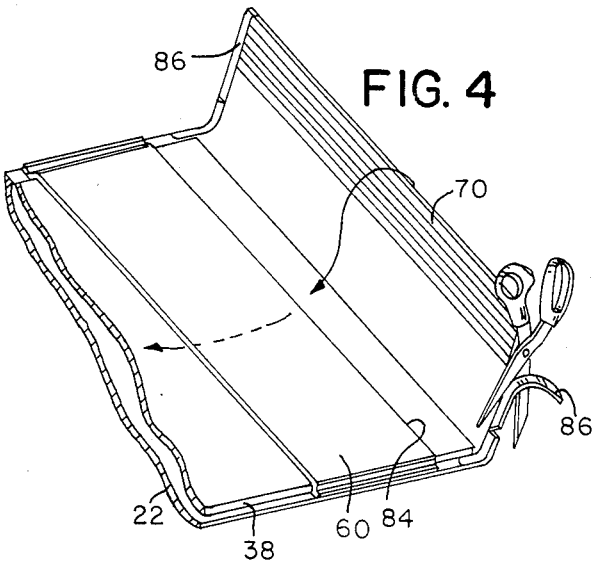
FIG. 5
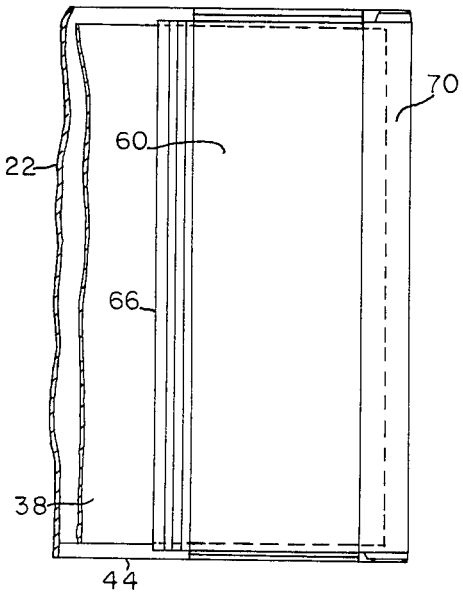

FIG. 6
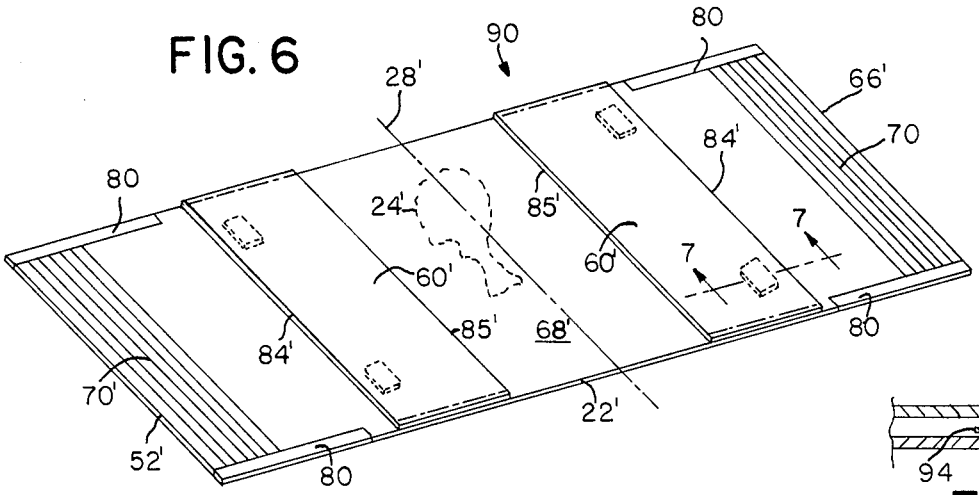
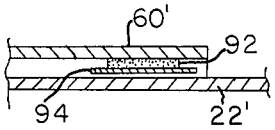
FIG. 7
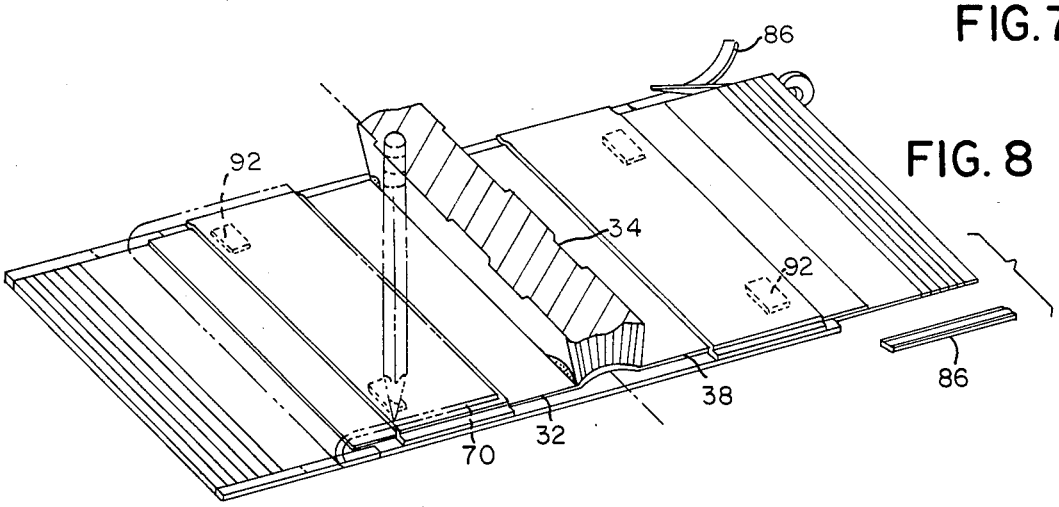
FIG. 8
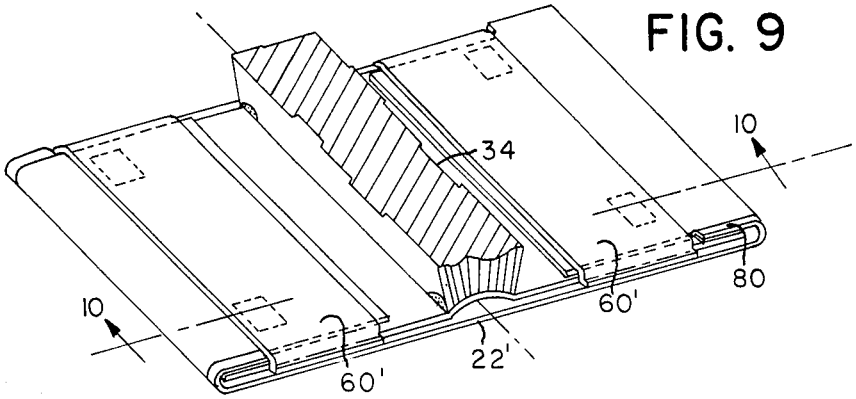
FIG. 9
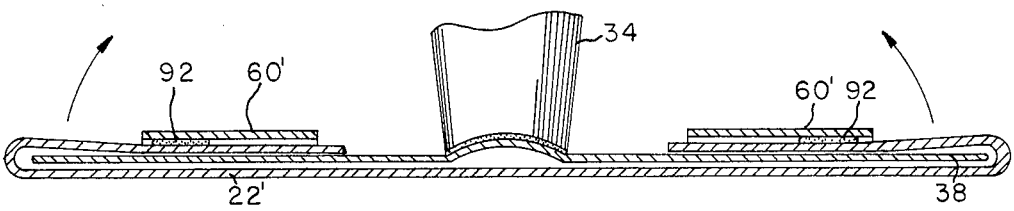
FIG. 10

FIG. 14
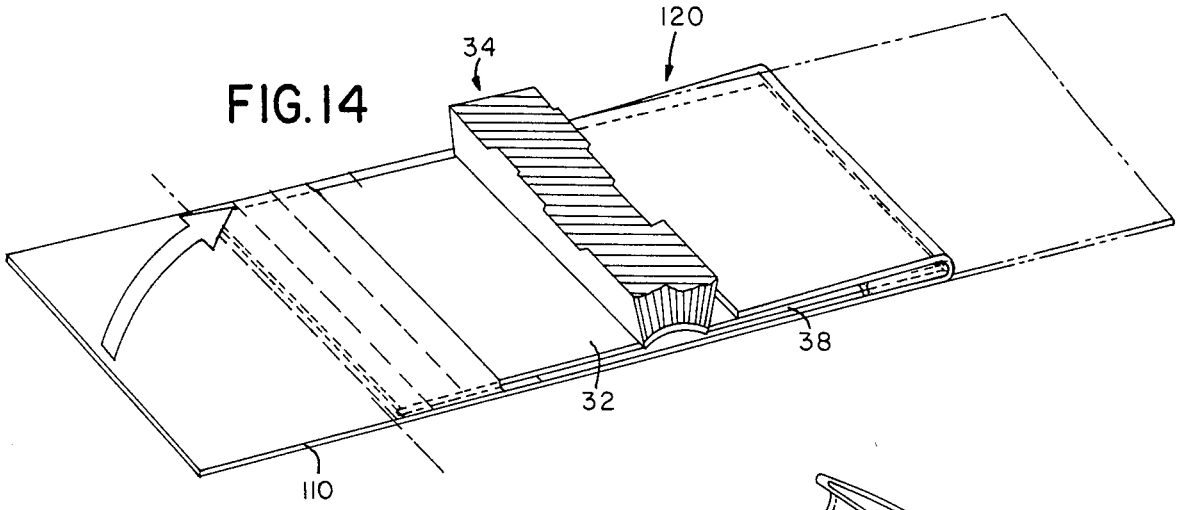
FIG. 15
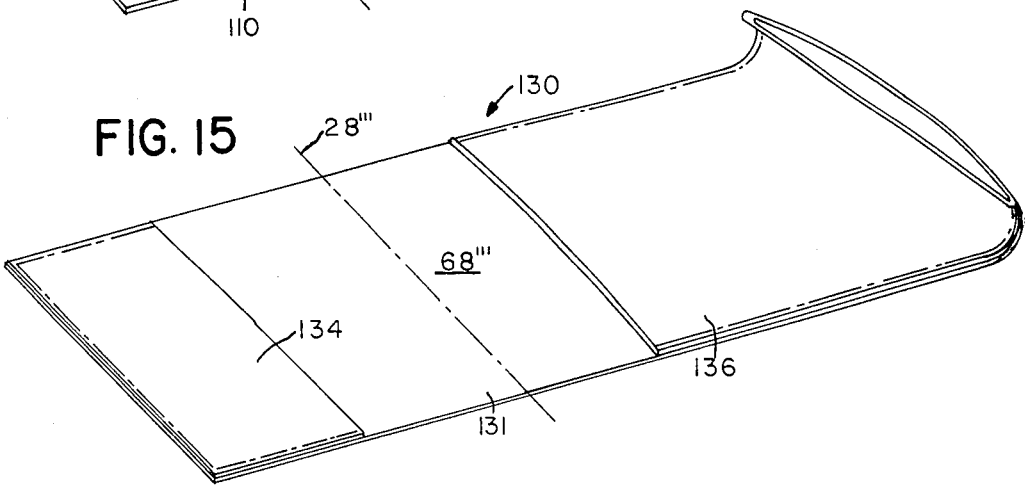
FIG. 16
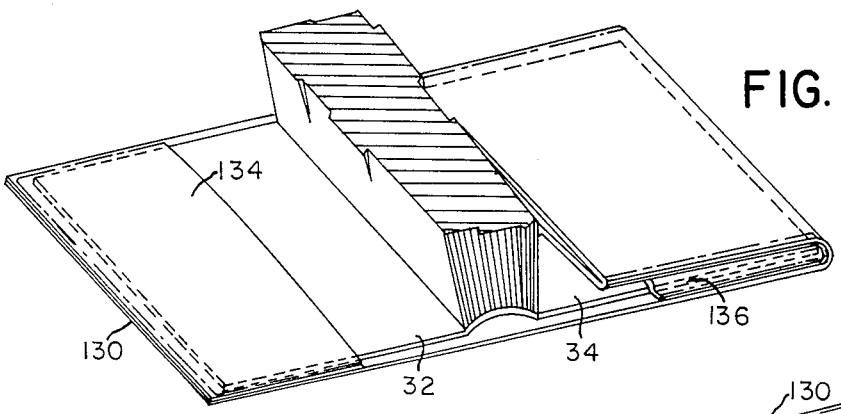
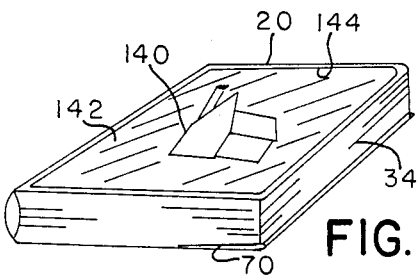
FIG. 18
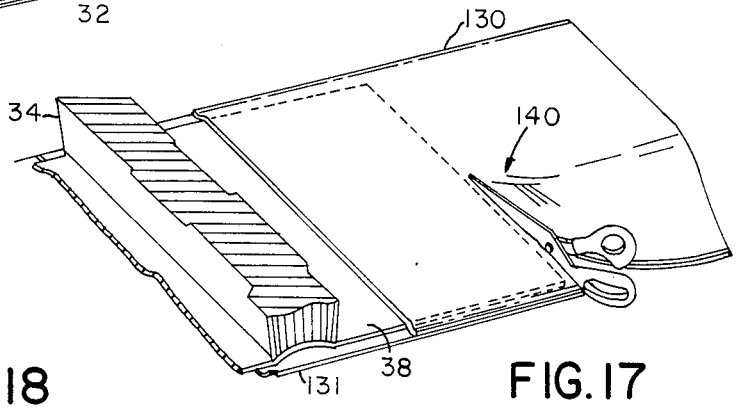
FIG. 17

BOOK JACKET

FIELD OF THE INVENTION

This invention generally relates to book jackets that can be placed around books. This invention particularly relates to book jackets for directories such as telephone books, airline schedule books and the like.

BACKGROUND OF THE INVENTION

Book jackets of various types for the protection of books have been known for probably as long as books have been published. The jackets can have a broad variety of shapes. In one book jacket, a plain rectangular paper is folded around the outer, front and back covers of the book to be protected and affixed with tape or the like. See, the example, U.S. Pat. Nos. 4,341,401 to Arntzen; 2,145,099 to Sharp; 4,209,187 to Forrest; and 1,595,002 to Davis. These book jackets are generally cumbersome to apply, particularly when the jacket has a decorative display that needs to overlay the outer front book cover, and thus requires careful alignment to obtain a proper fit.

In one known book jacket for telephone directories an outer sheet of vinyl is formed with a length selected to precisely fit with a book of known thickness and having known front and back cover dimensions. The outer sheet is provided with inner sheets that are affixed at the ends of the outer sheets to form pockets. The pockets are sized to receive the front and back outer book covers whose ends seat against the bottoms of the pockets. Such book jackets are made to fit one book size and do not fit around books whose outer covers are the same but have a greater thickness and do not fit snugly when placed around thinner books.

In French Pat. No. 807,264 a book jacket is provided with cover segments and end extensions. Sleeves are formed to wrap around the front and back book covers and may either be separate sleeves or be affixed to the end extensions to hold the jacket in place. As can be seen in the view of FIG. 2 of this patent, the book jacket does not conform closely to the book cover.

In French Pat. No. 2,048,098 a book binding is described formed of rigid front and back cover portions that are joined at hinges to a rigid spine whose thickness corresponds to the thickness of the book to be covered. One portion is provided with a jacket and the other portion has a sleeve. Such book binding, however, is intended for a book whose spine has a fixed thickness with front and back covers that are of fixed length.

SUMMARY OF THE INVENTION

With a book jacket in accordance with the invention, books of varying thicknesses, such as commonly encountered with directories such as airline schedules and telephone books, can be fit with a book jacket while obtaining a snug quality appearance. A book jacket may be provided with display material that can be placed at any specifically desired location with respect to the book to be jacketed, independent of the thickness of the book within a thickness range.

This may be obtained with one book jacket in accordance with the invention with the use of a continuous, thin, flexible, foldable outer sheet having first and second book covering segments. The outer sheet has sufficient length so that the book covering segments are separated from each other by an uninterrupted, flexible floating spine region whose width is sufficient to snugly wrap around spines of different thicknesses while enabling a close fit of the segments with the book's outer covers. An inner, thin, flexible and foldable sheet is affixed to one side of the outer sheet and includes at least first and second segments that are affixed to the book covering segments while being so spaced from each other as to enable engagement with and retention by the front and back book covers substantially independent of the thickness of the spine of the book to be covered.

The inner sheet segments may form a pocket and a sleeve attached to respective book covering segments or a sleeve at each book covering segement. The portion of the foldable sheet that is between the cover engaging parts of the segments forms a floating spine region that is uninterrupted and flexible so as to be foldable at desired spaced-apart locations to form a spine that automatically conforms to the spine of the book to be jacketed.

In another form for a book jacket in accordance with the invention, outer and inner sheets of book covering lengths are connected to each other along top and bottom edges to form a flat continuous sleeve. The book covers fit into the end openings of the continuous sleeve when its ends are folded back so as to accommodate book spines of different thicknesses. The flat continuous sleeve may be formed as a single plastic extrusion or by attaching two initially separate sheets together or by folding a single sheet and glueing or sealing the open edges to form a tube.

As further described herein for one form of a book jacket in accordance with the invention, one or several end flaps are provided that fold around the book front and back covers to fit between sleeve-forming sheets and the book covers. Each flap is provided with a trim line along top and bottom edges so as to define trim edges, which, when removed, enables one to freely fit the flaps under the sleeve-forming sheets. It is not essential to do this trimming for the flaps can still fit under the sleeve by folding or without folding and accepting a slight creasing of flap under the sleeve.

With a floating spine region in accordance with the invention, display material can be printed on the book jacket and designated, for example, for the spine. The jacket can then easily be mounted, and the printed material aligned with the book spine regardless of its thickness. The front portion of the book jacket intended to overlay the front cover of a book can be printed directly with advertising or other display material or a pre-printed sheet of paper can be sealed onto the front portion of the jacket under a separate transparent sheet that is attached to the jacket.

A book jacket in accordance with the invention is particularly convenient to make from a plastic outer sheet such as vinyl and to which an inner sheet is welded.

It is, therefore, an object of the invention to provide a book jacket by which one size can fit a large number of differently sized books. It is a further object of the invention to provide a one-size book jacket that can fit many commonly used directly books practically regardless of their thicknesses.

These and other advantages and objects of the invention can be understood from the following detailed description of several embodiments described in conjunction with the drawings.

BRIEF DESCRIPTION OF DRAWINGS

FIG. 1 is a perspective partly broken-away view of a book jacket in accordance with the invention;

FIG. 1A is an enlarged view of a portion of the book jacket as shown in FIG. 1;

FIG. 2 is a section view of the book jacket taken along the line 2—2 in FIG. 1;

FIG. 3 is a perspective view of the application of the book jacket of FIG. 1 on a book;

FIG. 4 is a partial plan view of the placement of an end flap under a sleeve in its application to a book;

FIG. 5 is a partial plan view of the installed end flap of the book jacket of FIG. 1;

FIG. 6 is a perspective view of another book jacket in accordance with the invention;

FIG. 7 is a section view of the book jacket taken along the line 7—7 in FIG. 6;

FIG. 8 is a perspective view of a first step involved in the placement of the book jacket of FIG. 6 on a book;

FIG. 9 is a perspective view of a subsequent step in the placement of the book jacket of FIG. 6 on a book;

FIG. 10 is a side section view of the installed book-jacket as taken along the line 10—10 in FIG. 9.

FIG. 14 is a perspective view of the book jacket of FIG. 13 and applied to a book;

FIG. 15 is a perspective view of still another form for a book jacket in accordance with the invention;

FIG. 16 is a perspective view of the book jacket of FIG. 15 installed on a book;

FIG. 17 is a partial perspective view of the book jacket of FIG. 16, but showing use of an alternate technique to complete mounting to a book; and FIG. 18 is a perspective view of a book jacket in accordance with FIG. 1 as mounted to a book and having its front portion decorated by means of a pre-printed sheet that is sealed into place.

DETAILED DESCRIPTION OF DRAWINGS

Figure 11:
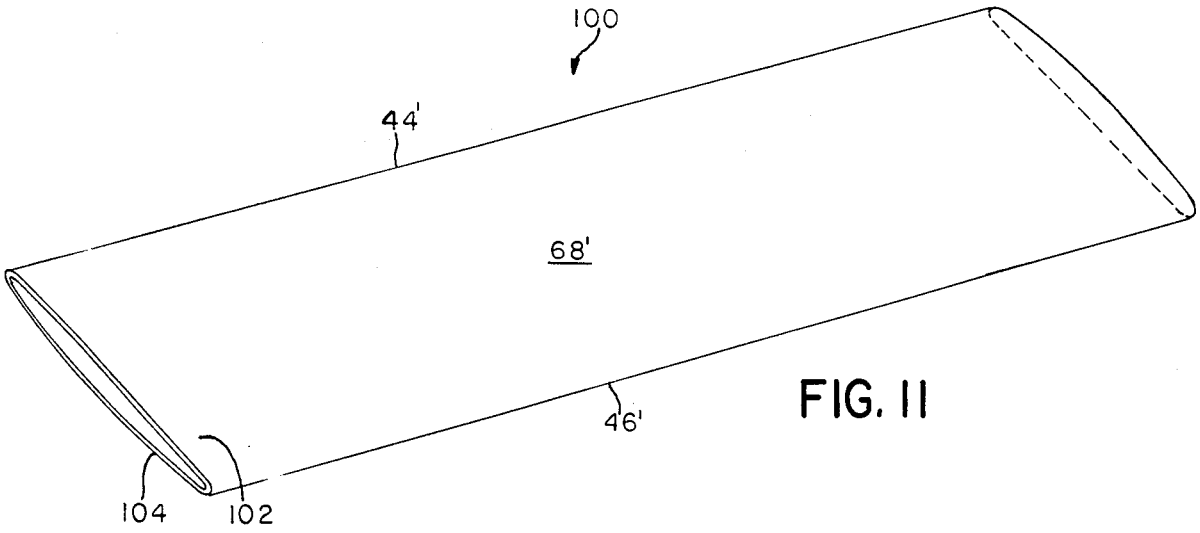
FIG. 11 is a perspective view of a flat continuous-sleeve form for a book jacket in accordance with the invention.

With reference to FIGS. 1-5, a book jacket 20 is shown formed of a thin, foldable and flexible sheet 22 in rectangular form. Sheet 22 may be made of a variety of different materials, but in the preferred embodiment, is made of vinyl capable of being cut and welded onto as is well-known in the art. The sheet 22 may be printed on as suggested by the dashed display 24 on the surface that is on the other side of the surface 26 visible in the view of FIG. 1. Line 28 represents the middle of sheet 22 and separates a front-covering segment 30 intended to overlay the front outer cover 32 of a book 34 and a back-covering segment 36 intended to overlay the back outer cover 38 of book 34.

Sheet 22 has a pocket-forming sheet portion 40 that is opposite segment 30 and extends generally between the top and bottom edges 42, 44, which are spaced to accommodate a book of a particular height, and is welded to these edges as shown by weld lines 46, 48. Sheet portion 40 may be a separate sheet, in which case there preferably is a third weld line 50 at end 52 to form the bottom of a pocket 54.

A pocket 54 may also be formed by making sheet 22 sufficiently long so that its end 52 can be folded back to where the opening 56 of pocket is desired. In such case two weld lines can suffice, though for purposes of reducing the bulkiness of the fold at the bottom of the pocket 54 a third weld line 50 could still be used.

Sheet 22 is further provided with a sleeve forming sheet 60 that extends generally between the top and bottom edges 42, 44 and is welded to sheet 22 by weld lines 62, 64 near the latter edges. Sleeve forming sheet 60 is located opposite book covering segment 36 and between pocket 54 and end 66 of sheet 22 so as to define a floating spine region 68 and an end flap 70. The sleeve-forming sheet 60 and pocket-forming sheet 40 are so spaced from each other so as to enable engagement with and retention by the front and back book covers regardless of the thickness of the spine of the book 34 within a practical range of spine sizes.

Spine region 68 is flat and uninterrupted by predesignated spine-forming-folds and yet sufficiently flexible so as to be able to wrap around a spine of a book such as at 72 regardless of its thickness. The width W of the floating spine region is made to accommodate a large number of differently sized books whose front and back covers fit into pocket 54 and under sleeve 60 but whose spine thickness is within a practical range, for example, up to three inches for telephone books. For a book jacket 20 intended for conventional telephone books, a single book jacket 20 size can be used while the book spine can be placed anywhere between the limits of the spine region 68.

End flap portion 70 is made sufficiently long so as to be able to fold around the back cover 38 of book 34 and still fit between sleeve forming sheet 60 and cover 38. Since sheet 22 is rectangular and it is desired that flap portion 70 freely fit beneath the sleeve 60, flap portion 70 is provided with trim lines 74, 76 that are respectively parallel to top and bottom edges 42, 44 but slightly spaced therefrom to define trim edges 78, 80.

When a book jacket 20 is to be placed over a book, the trim edges 78, 80 may be cut away to the extent needed to more freely fit beneath sleeve 60 yet provide a neat appearance to the front side of jacket 20. This is done as shown in FIG. 3 where the front cover is first placed in pocket 54 and the back cover passed under sheet 60. The flap portion 70 is then folded back as illustrated and a pencil mark 82 is made across each of the trim edges 78, 80 at a place that is preferably slightly towards the side of the far edge 84 of sleeve 60.

The extreme portion 86 of the trim edges 78, 80 are then cut away to the pencil lines 82 as shown in FIG. 4 and the flap 70 tucked under sleeve 60 until the flap is in position as shown in FIG. 5. However, the trimming away of edges 78, 80 is not essential and is done to achieve a neater appearance of the jacket. If the edges are not trimmed away, end 66 of sheet 22 may still be passed under sheet 60. In such case end 66 can be folded over or left as is but with a slight creasing occurring, which would not look objectionable when the cover is fitted onto a book.

In some cases the book spine 72 may be so thin that end flap 70 may span all the way across book cover 38 in interference with the pages. For this reason end flap 70 is provided with trim lines 88 for cutting to facilitate its shortening.

A book jacket 20 in accordance with the invention and made to fit most conventional telephone directories was formed with an overall length of about 25 inches and a width of 113/16 inches. The depth of pocket 54 was 6¼ inches, the distance of edge 85 of sleeve 60 from the opening 56 of pocket 54 was about 711/16 inches and the width of sleeve 60 was 43/16 inches. This left a floating spine region of about five inches and was about 20% of the overall length. End flap portion 70 was about 7 inches long. Preferably, the spine region should be at least greater than about three inches; and the overall length, at least longer than about 22 inches.

With reference to FIGS. 6–10 an alternate book jacket 90 is illustrated using another sleeve forming sheet 60' in place of pocket forming sheet 40 of FIG. 1 and 2. The sleeve 60' is symmetrically placed with sleeve 60 relative centerline 28'. The use of similar but primed numbers as in FIGS. 1–5 indicates like parts with similar functions.

The placement of the covers 32, 38 of a book 34 within the sleeves 60, 60' is done as described with respect to FIG. 3. However, with a book jacket 90 a printed pattern 24' on the exposed side of the floating spine 68' can be conveniently aligned with the spine 72' of book 34 regardless of its thickness.

Book jacket 90 further includes adhesive pads 92 located between the sleeve forming sheets 60, 60' and the sheet 22'. The pads 92 are covered by a release paper 94 that is removed after end flaps 70, 70' have been tucked under sleeves 60, 60'. Release papers 94 are then removed, and the sleeves 60, 60' pressed against the tucked under flaps 70, 70' as shown in FIG. 10 to keep the book jacket in place. The adhesive pads are optional and not essential.

In one embodiment for a book jacket 90 for telephone books the overalllength of sheet 22' was about 29½ inches and the width was 11⅛ inches. The sleeves, which were 4 inches wide, had their edges about 6½ inches from the ends 52' and 66' of sheet 22', leaving a floating spine region of about 4 inches long or approximately 13 percent of the overall length. Preferably the floating spine region should not be less than about 10 percent of the overall length.

Figure 12:
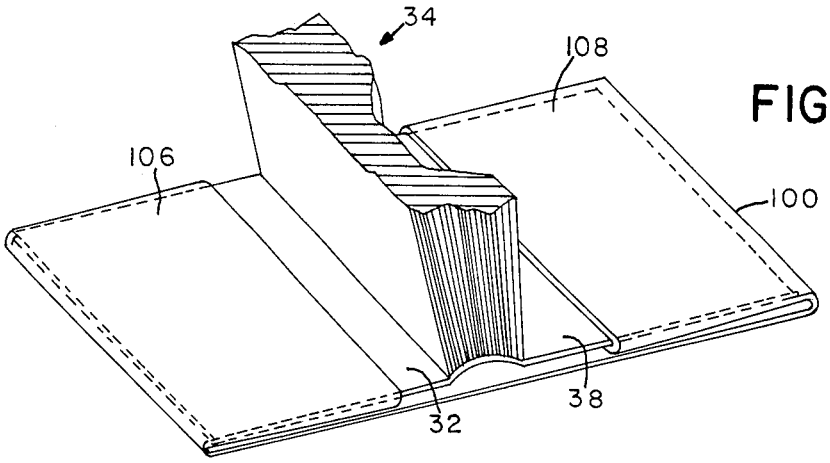
FIG. 12 is a perspective view of the installed book jacket of FIG. 11.

FIG. 11 shows a book jacket 100 formed of a pair of like-sized and generally coextensively-placed inner and outer sheets 102, 104. Sheets 102, 104 maybe formed of paper or plastic and are bonded together along top and bottom edges 44', 46' or formed integrally connected together by extrding a thin flexible flat continuous tubular form that is then cut to size. The book jacket 100 can be made from other materials such as paper that is folded and then glued at the open edge to form a flat sleeve. Different bonding techniques can be used. The book jacket 100 is sized so that its height between edges 42, 44 is sufficient to receive the front and back covers 32, 38 of book 34 when end segments 106, 108 are folded back as shown in FIG. 12. The length of book jacket 100 is selected sufficiently long to accommodate book spines of different thicknesses while receiving sufficient portions of book covers 32, 28 to attach to them. The book jacket 100 may be provided with a display pattern that can be conveniently placed opposite desired portions of a book to be covered.

Figure 13:
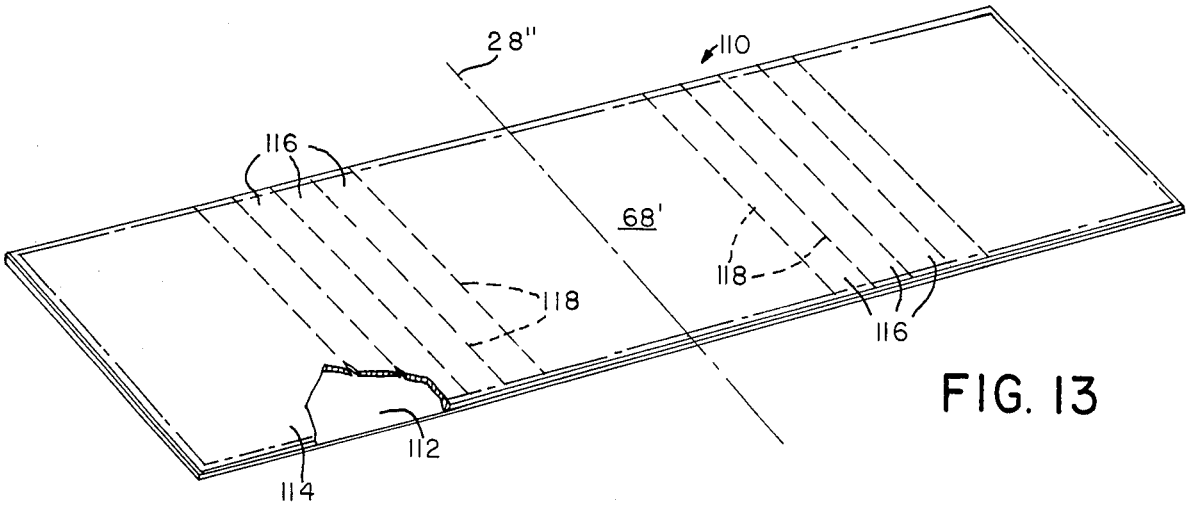
FIG. 13 is a perspective partially broken away view of a modified form of the book jacket of FIG. 11.

FIG. 13 illustrates a book jacket 110 where outer and inner sheets 112, 114 are connected together around the entire perimeters of the sheets. The inner sheet 114 is further provided with tear away strips 116 by use of appropriate score lines 118. When strips 116 are removed on each side of the center line 28" a pocket is provided to receive the covers of a book as shown in FIG. 14. The book jacket 110 is made sufficiently long so that the ends can be folded back as shown at 120.

In the embodiment of FIGS. 15–17 a book jacket 130 is shown with an outer sheet 131 and an inner sheet 132 formed into a pocket 134 at one end and an elongated sleeve 136 at the other end and with a floating spine region 68 in between. When the book jacket is mounted to a book, the end with the elongate sleeve 136 can be folded back as shown in FIG. 16 or the excess portion cut away as shown at 140 in FIG. 17 along a line that is flush with the end of the back book cover 38.

A book jacket in accordance with the invention can be made with a great variety of widths for the floating spine region. Preferably, the spine region is made to accommodate a broad range of spine thicknesses. Depending upon the size of the book covers, the width of the spine region is likely to be from about 2 percent to about 20 percent of the overall length of the book jacket.

FIG. 18 shows a book jacket such as 20 of FIG. 1 placed over a book 34. Jacket 20 is further provided with a decorative insert 140 sealed into place beneath a transparent cover sheet 142. Sheet 142 can be sealed along its peripheral edges 144 to the jacket 20. Sheet 142 can be formed into an external pocket by only attaching it to jacket 20 along three edges. Sealing of a separate decorative sheet onto a rigid, fixed-spine, three-ring binder with a transparent sheet is known in the art.

Having thus described several embodiments for a book jacket in accordance with the invention, its advantages can be understood. Variations from the embodiments can be made without departing from the scope of the invention. For example, a book jacket in accordance with the invention can be designed for a particular book size, yet can be snugly fitted onto books with smaller spine widths while preserving a neat appearance.

What is claimed is:

1. A jacket for a book having front and back outer covers of known dimensions and that are attached to each other along a spine whose thickness may vary depending upon the number of pages in the book, comprising:

an outer, thin, flexible, foldable continuous plastic sheet having first and second book-covering segments and further having top and bottom edges that are separated from each other by a distance that is generally commensurate with the height of a book to be covered, the length of said outer flexible sheet being sufficient so that said first and second outer book-covering segments are separated from each other by a floating uninterrupted flexible spine region whose width is sufficient to wrap around spines of different thicknesses within a range, the width of the floating spine region being greater than about two percent and generally less than about 20 percent of the overall length of the book jacket;

an inner, thin, flexible foldable plastic sheet affixed to the outer sheet and having at least first and second book cover engaging segments, said latter sheet segments being affixed to the outer sheet opposite the book-covering segments thereof to enable the front and back book covers to fit between the outer sheet and said first and second book cover engaging segments of said inner sheet, said latter segments further being affixed to the outer sheet at locations that are so spaced from each other so as to enable engagement with and retention of the front and back book covers regardless of the thickness, within a thickness range, of the spine of the book to be covered;

the inner sheet being further formed of separate individual first and second sheets, the first of said latter sheets being affixed to the outer sheet at one end thereof as well as near said top and bottom edges to form a pocket shaped to snugly receive the front outer cover of the book and enable predetermined alignment of a display thereon with respect to said outer sheet, the second of said separate individual sheets being affixed to the outer sheet at a location selected to maintain said engagement with and retention by the back outer cover of the book substantially independent of the thickness of the spine of the book to be covered.

2. The book jacket as claimed in claim 1 and further including a display bearing sheet overlying a book-covering segment of the outer sheet and a transparent flexible sheet affixed to the outer sheet on a side thereof that is opposite to the side where said inner sheet is located and being located to overlay a book-covering segment and said display bearing sheet.

3. The book jacket as claimed in claim 2 wherein said transparent flexible sheet is affixed around its perimeter to the book-covering segment to seal in said display bearing sheet.

4. The book jacket as claimed in claim 3 wherein said inner, outer and transparent flexible sheets are made of vinyl and are welded together.

* * * * *